US009713390B1

(12) United States Patent
Charters

(10) Patent No.: US 9,713,390 B1
(45) Date of Patent: Jul. 25, 2017

(54) PILLOW CASE INSTALLER

(71) Applicant: Don Charters, Vancouver (CA)

(72) Inventor: Don Charters, Vancouver (CA)

( * ) Notice: Subject to any disclaimer, the term of this patent is extended or adjusted under 35 U.S.C. 154(b) by 147 days.

(21) Appl. No.: 14/669,406

(22) Filed: Mar. 26, 2015

Related U.S. Application Data

(60) Provisional application No. 61/970,733, filed on Mar. 26, 2014.

(51) Int. Cl.
*A47C 21/02* (2006.01)
*A47G 9/02* (2006.01)

(52) U.S. Cl.
CPC ..... *A47C 21/028* (2013.01); *A47G 9/0253* (2013.01)

(58) Field of Classification Search
CPC ..... A47C 21/028; A47G 9/0253; A47G 2009/0269; A47G 9/04; A47G 9/10; B65D 85/16
USPC ..... 5/487–489
See application file for complete search history.

(56) References Cited

U.S. PATENT DOCUMENTS 359,617 A * 3/1887 Leonard ..... A47C 21/028 5/489
804,456 A * 11/1905 Condo ..... A47C 21/028 5/489
827,008 A * 7/1906 Gilmore ..... A47C 21/028 5/489
1,275,205 A * 8/1918 Bigham et al. ..... A47G 9/0253 5/487
1,712,711 A * 5/1929 Morgan ..... A47C 21/028 5/489
5,239,741 A * 8/1993 Shamos ..... B21D 51/52 29/521
5,673,446 A 10/1997 Moen et al.
5,716,033 A 2/1998 Gibson
6,340,037 B1 1/2002 Stafford
6,839,923 B2 1/2005 Blessman
7,958,580 B2 * 6/2011 Zorger ..... A47G 9/0253 141/390
7,971,294 B1 7/2011 Murauskos
2006/0185086 A1 * 8/2006 Lucas ..... A47C 21/028 5/489
2013/0087141 A1 * 4/2013 Williams ..... A61F 5/028 128/100.1

* cited by examiner

*Primary Examiner* — Nicholas Polito
*Assistant Examiner* — Myles Throop
(74) *Attorney, Agent, or Firm* — QUICKPATENTS, LLC; Kevin Prince

(57) ABSTRACT

An insertion device facilitates the insertion of a compressible pillow into a flexible pillowcase. A left edge of a resilient sheet includes a compression handle stem projecting away therefrom and terminating at a first compression handle. A right edge of the sheet includes a second compression handle projecting away therefrom. The sheet further includes a horizontal slot traversing therethrough, the slot sharing a common longitudinal axis with the compression handle stem. The resilient sheet when curved around itself, with the compression handle and the compression handle stem traversing the horizontal slot, form an enclosure into which the pillow is inserted. The compression handle is pulled away from the second compression handle to constrict the pillow, which, with the enclosure, is then easily inserted into the pillowcase.

16 Claims, 3 Drawing Sheets

PILLOW CASE INSTALLER

CROSS-REFERENCE TO RELATED APPLICATIONS

This application claims the benefit of U.S. Provisional Patent Application 61/970,733, filed on Mar. 26, 2014, and incorporated herein by reference.

STATEMENT REGARDING FEDERALLY SPONSORED RESEARCH AND DEVELOPMENT

Not Applicable.

FIELD OF THE INVENTION

This invention relates to bedding, and more particularly to a device for facilitating the installation of a pillowcase onto a pillow.

DISCUSSION OF RELATED ART

Casing pillows is a tedious and difficult task. Bigger pillows can be problematic for casing due to their size and inability to be easily compressed. Workers can be required to case a multitude of pillows if they have a job in a hospital, hotel, or cruise ship, and the time represented in struggling with casing pillows is significant.

Devices are known in the prior art that are designed to provide support to flexible bags or support a pillow in a collapsed configuration so that it can more easily be inserted into a pillowcase. One prior art device, taught in U.S. Pat. No. 5,716,033 to Gibson on Feb. 10, 1998, provides a removable internal support for a flexible back comprising a thin sheet of material and a pair of T-shaped connectors designed to affix together and hold the device in a cylindrical shape. Another device, taught in U.S. Pat. No. 6,839,923 to Blessman on Jan. 11, 2005, provides a means for inserting a pillow into a pillowcase comprising a flexible member that can be folded into a U-shape and placed into a pillowcase in order to hold the pillowcase open. Neither of these prior art devices facilitates compression of the pillow, even a relatively large pillow, while also providing a means for maintaining compression thereof during insertion of the pillow and the device into the pillowcase.

Therefore, there is a need for a device that facilitates compression of the pillow while also providing a means for maintaining compression thereof during insertion of the pillow and the device into the pillowcase. Further, such a needed invention would facilitate a wider opening of the pillowcase, and would provide means for easily removing the device from between the pillow and the pillowcase once the pillow is installed within the pillowcase. The present invention accomplishes these objectives.

SUMMARY OF THE INVENTION

The present device facilitates the insertion of a compressible pillow into a flexible pillowcase. A resilient sheet has a front side, a rear side, a top edge, a bottom edge, a left edge, and a right edge. The left edge includes a compression handle stem projecting away therefrom and terminating at a first compression handle. The right edge includes a second compression handle projecting away therefrom. The sheet further includes a horizontal slot traversing from the front side to the rear side, the slot sharing a common longitudinal axis with the compression handle stem.

In use, the left edge of the resilient sheet is curved around itself such that the compression handle and the compression handle stem traverse the horizontal slot from the rear side to the front side, forming an enclosure. The pillow is inserted into the enclosure and the compression handle is pulled away from the second compression handle to cause the sheet to constrict the pillow. The pillow and the sheet are then easily inserted into the pillowcase where, thereafter, the sheet is removed from between the pillow and the pillowcase, leaving the pillow installed in the pillowcase.

In one embodiment, the top edge of the resilient sheet further includes a plurality of deflectors projecting away therefrom, each deflector angled towards the rear side, such that when the sheet is formed into the enclosure the deflectors facilitate the insertion of the enclosure and the pillow into the pillowcase by deflecting the pillowcase material into a more open configuration. A handle fastening mechanism may also be fixed adjacent the horizontal slot that is adapted to selectively fix the compression handle and the compression handle stem with the resilient sheet adjacent the slot so as to maintain constriction of the pillow after the compression handles are pulled apart. In one embodiment, the bottom edge of the resilient sheet includes at least one removal handle, such that the sheet may be slid out from between the pillow and the pillowcase by pulling on the at least one removal handle.

The present invention facilitates compression of the pillow while also providing a means for maintaining compression thereof during insertion of the pillow and the device into the pillowcase. Further, the present invention facilitates a wider opening of the pillowcase, and provides means for easily removing the device from between the pillow and the pillowcase once the pillow is installed within the pillowcase. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
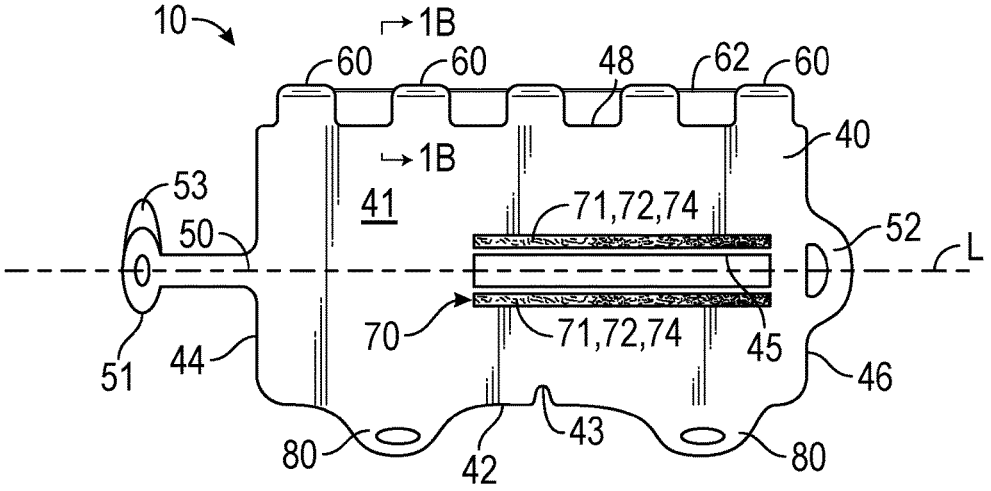
FIG. 1A is a top plan view of the invention, illustrated in a flat configuration.
Figure 2:
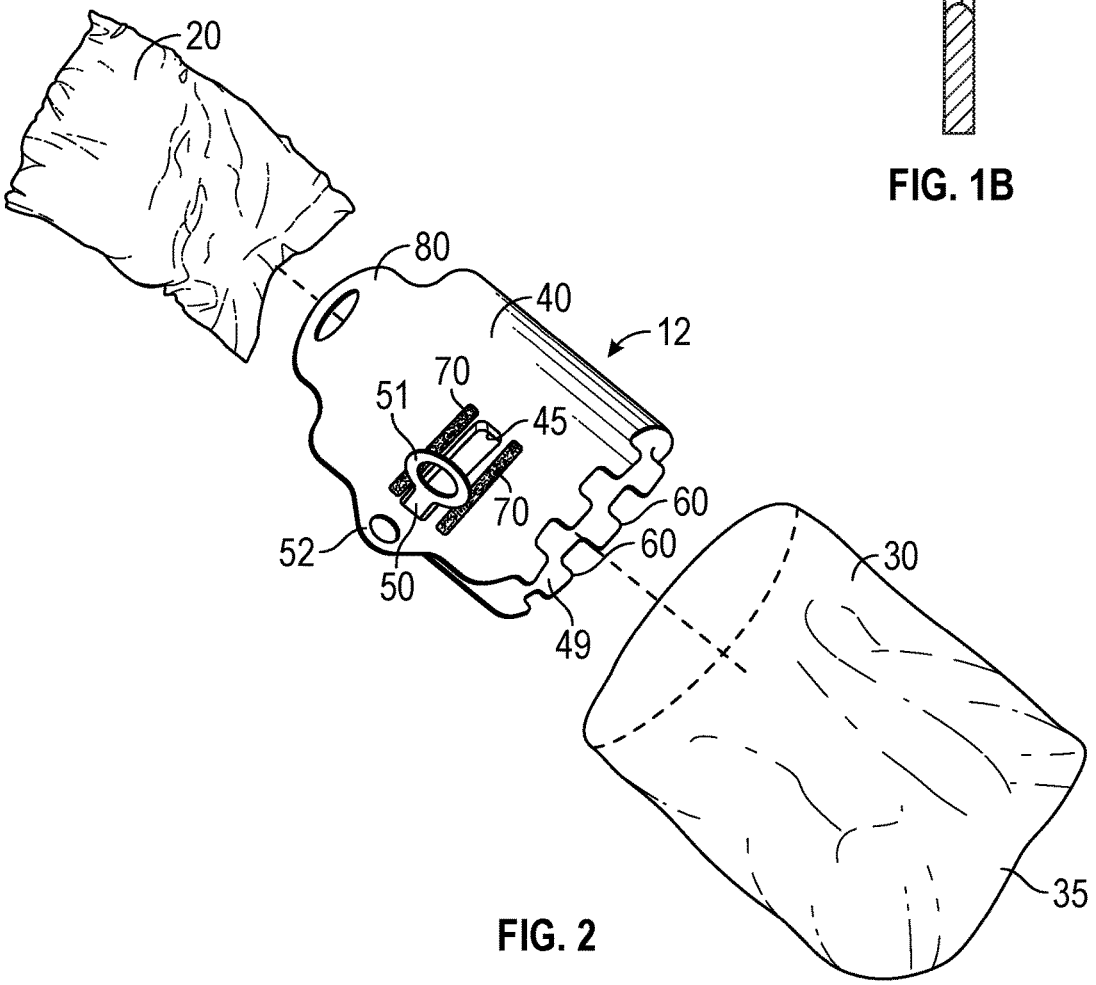
FIG. 2 is an exploded perspective view of the invention, illustrated with the invention in positioned to form an enclosure for a pillow.

FIGS. 1A and 2 illustrate an insertion device 10 for facilitating the insertion of a compressible pillow 20 into a flexible pillowcase 30. A resilient sheet 40 has a front side 41, a rear side 49, a top edge 48, a bottom edge 42, a left edge 44, and a right edge 46. While FIG. 1A illustrates a generally rectangular-shaped sheet 40, the device 10 may also be formed in other shapes as desired, such as oval, trapezoidal, or the like (not shown). The insertion device 10 is preferably stamped or formed from a single sheet of smooth plastic material, such as 1 mm polyethylene or the like. The top edge 48, bottom edge 42, left edge 44 and right edge 46 are all preferably rounded so as not to become caught on the pillow 20 or pillowcase 30.

The left edge 44 includes a compression handle stem 50 projecting away therefrom and terminating at a first compression handle 51. The right edge 46 includes a second compression handle 52 projecting away therefrom. The sheet 40 further includes a horizontal slot 45 traversing from the front side 41 to the rear side 49, the slot 45 sharing a common longitudinal axis L (FIG. 1A) with the compression handle stem 50.

Figure 3:
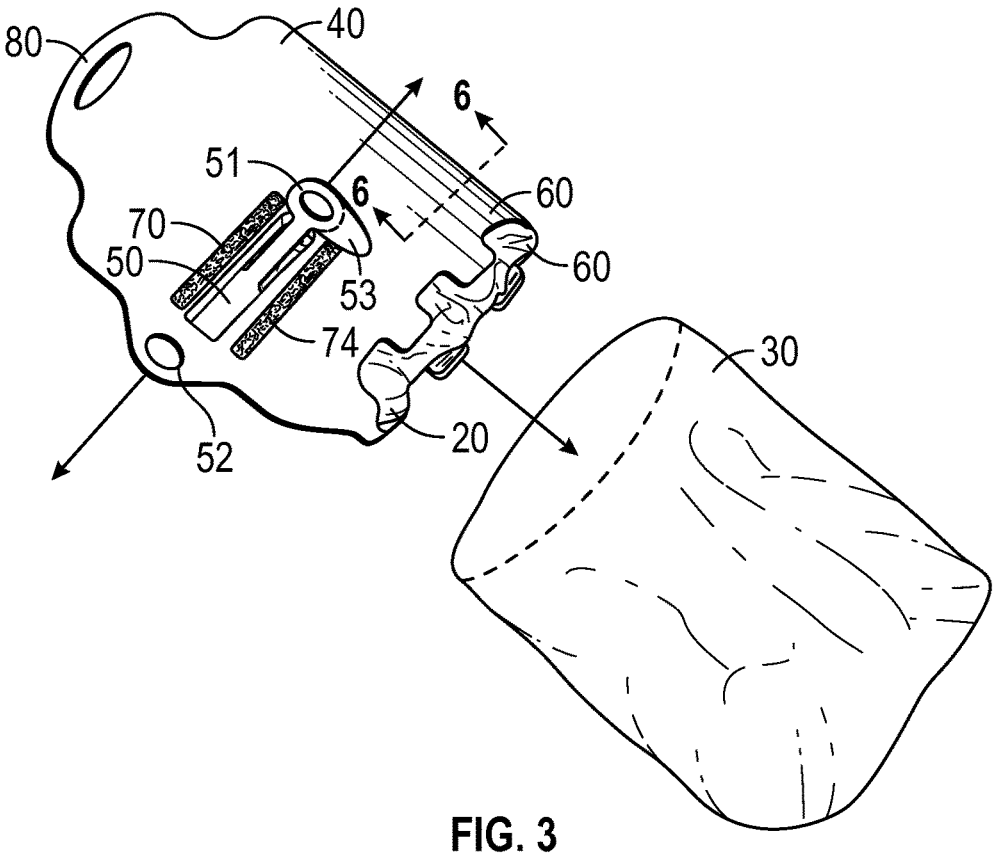
FIG. 3 is an exploded perspective view of the invention, illustrated with the pillow compressed within the enclosure.
Figure 4:
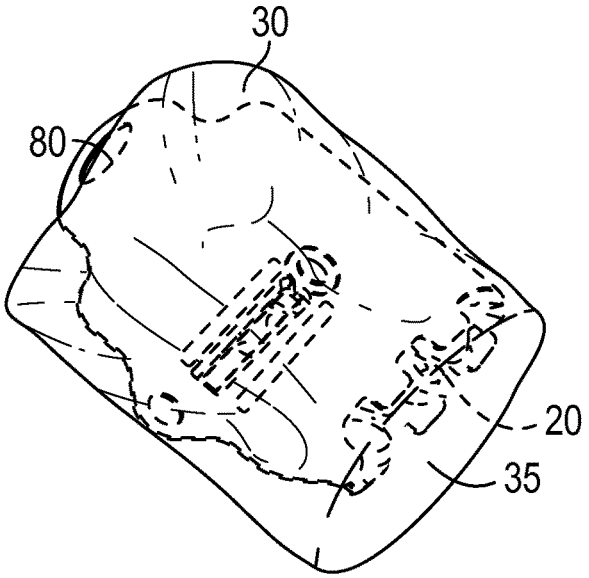
FIG. 4 is a perspective view showing the enclosure of the invention and the pillow as inserted into a pillowcase.
Figure 5:
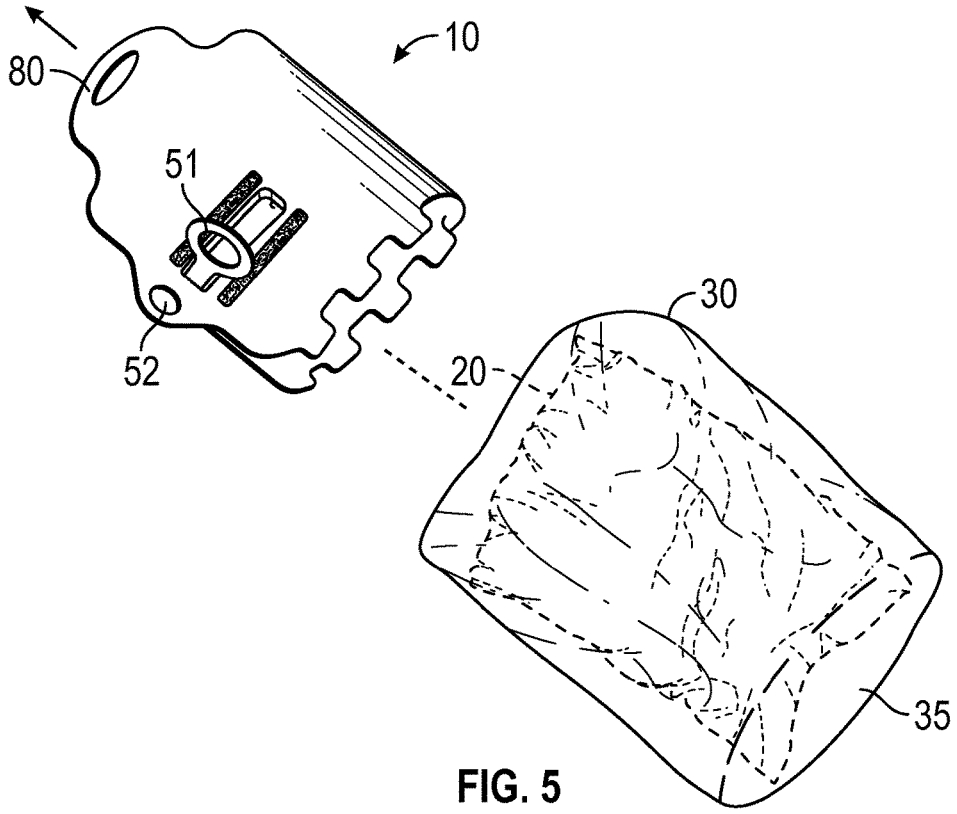
FIG. 5 is a perspective view showing the enclosure pulled away from the pillow, leaving the pillow in the pillowcase.

In use, the left edge 44 of the resilient sheet 40 is curved around itself such that the compression handle 51 and the compression handle stem 50 traverse the horizontal slot 45 from the rear side 49 to the front side 41, forming an enclosure 12 (FIG. 2). The pillow 20 is inserted into the enclosure and the compression handle 51 is pulled away from the second compression handle 52 to cause the sheet 40 to constrict the pillow 20 (FIG. 3). The pillow and the sheet 40 are then easily inserted into the pillowcase (FIG. 4). The sheet 40 is then removed from between the pillow 20 and the pillowcase 30 (FIG. 5), leaving the pillow 20 installed in the pillowcase 30. The pillow 20 may be grasped through the closed end 35 of the pillowcase 30 with one hand while pulling the sheet 40 away from between the pillow 20 and the pillowcase 30 with the other hand, for example. After use the enclosure 12 may be stored under a bed or in a closet, for example. Alternately, the resilient sheet 40 may be placed into its flat configuration (FIG. 1A) and stored easily between mattresses or under a bed, for example.

Figure 1B:
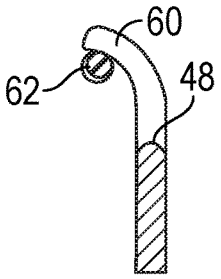
FIG. 1B is a cross-sectional view of one embodiment of the invention, taken generally along line 1B-1B of FIG. 1A.

In one embodiment, the top edge 48 of the resilient sheet 40 further includes a plurality of deflectors 60 projecting away therefrom, each deflector 60 angled towards the rear side 49, such that when the sheet 40 is formed into the enclosure 12 the deflectors 60 facilitate the insertion of the enclosure 12 and the pillow 20 into the pillowcase 30 by deflecting the pillowcase material into a more open configuration. In one embodiment, the plurality of deflectors 60 may be pulled mutually together with a length of elastic cord 62 (FIGS. 1A and 1B) or the like. Alternately, the plurality of deflectors 60 may be heat treated and bent during manufacturing, such that each deflector 60 retains a bent shape towards the rear side 49.

Figure 6:
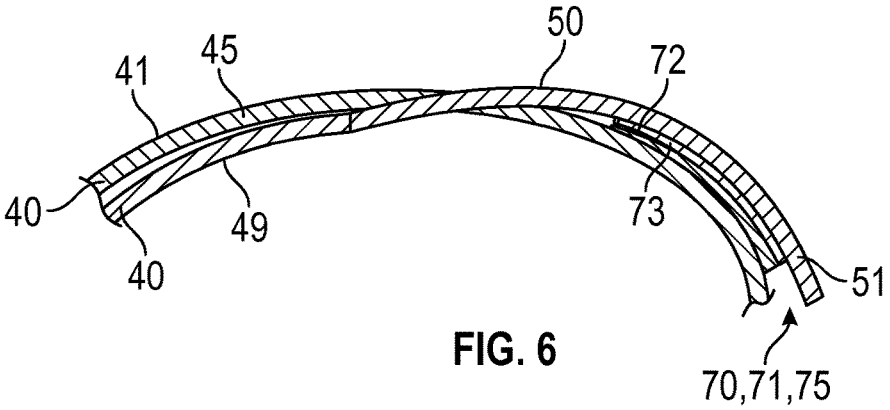
FIG. 6 is a partial cross-sectional view, taken along lines 6-6 of FIG. 3.

In one embodiment, a handle fastening mechanism 70 is fixed adjacent the horizontal slot 45 that is adapted to selectively fix the compression handle 51 and the compression handle stem 50 with the resilient sheet 40 adjacent the slot 45 so as to maintain constriction of the pillow 20 after the compression handles 51,52 are pulled apart. Such a handle fastening mechanism 70 may be, for example, a two-part mechanical fastener 71 having a first part 72 fixed adjacent the horizontal slot 45 and a second part 73 which is fixed with a rear side of the compression handle 51. Such a two-part mechanical fastener 71 may be a hook-and-loop type material 74, a plurality of magnets 75, or the like (FIG. 6). As such, with the handle 51 formed wider than the slot 45 to at least partially overlap the sheet 40, the handle 51 is pressed down against the sheet 40 to secure the handle 51 to the sheet 40.

Figure 7:
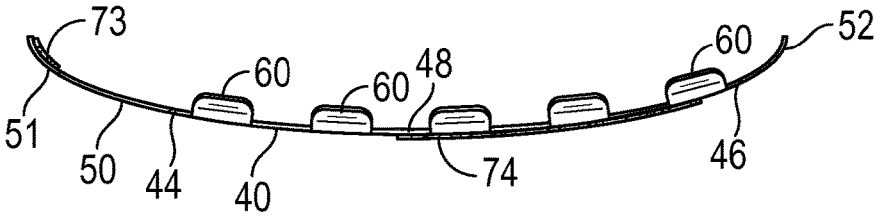
FIG. 7 is a top plan view of one embodiment of the invention, showing a curved resilient sheet thereof.

In one embodiment, the bottom edge 42 of the resilient sheet 40 includes at least one removal handle 80 (FIG. 1A), such that the sheet 40 may be slid out from between the pillow 20 and the pillowcase 30 by pulling on the at least one removal handle 80. A notch 43 in the bottom edge 42 of the resilient sheet 40 allows the bottom edge 42 of the resilient sheet to flex inward slightly upon removal thereof from between the pillow 20 and the pillowcase 30, so as not to become caught on the pillowcase 30. In one embodiment the compression handle 51 includes a tapered ramp 53 for reducing the chance of the pillowcase 30 catching or getting hung-up on the handle 51 (FIG. 1A). In one embodiment, the resilient sheet 40 has a curve formed therein at the left and right edges 44,46 in order to facilitate the sheet 40 being curved to form the enclosure 12 (FIG. 7).

While a particular form of the invention has been illustrated and described, it will be apparent that various modifications can be made without departing from the spirit and scope of the invention. For example, the specific number, size and positioning of the plurality of deflectors 60 may be varied, as well as the size and shape of the compression handles 51,52 and each removal handle 60. Likewise, the compression handle stem 50 may be relatively short, forming merely a waist (not shown) between the compression handle 51 and the left edge 44 of the resilient sheet. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An insertion device for facilitating the insertion of a compressible pillow into a flexible pillowcase, comprising:

a resilient sheet having a front side, a rear side, a top edge, a bottom edge, a left edge, and a right edge, the left edge including a compression handle stem projecting away therefrom and terminating at a compression handle, the right edge including a second compression handle projecting away therefrom, the sheet further including a horizontal slot traversing from the front side to the rear side and sharing a common longitudinal axis with the compression handle stem;

the top edge of the resilient sheet further including a plurality of deflectors projecting away therefrom and angled towards the rear side;

wherein the sheet is configured to be capable of having the left edge of the resilient sheet curved around itself such that the compression handle and compression handle stem traverse the horizontal slot from the rear side to the front side, the sheet forming an enclosure for the pillow that with pulling of the compression handle away from the second compression handle causes the sheet to constrict the pillow such that the pillow and the sheet are capable of being inserted into the pillowcase, the deflectors facilitating the insertion of the enclosure and the pillow into the pillowcase by deflecting the pillowcase material into a more open configuration, wherein the sheet is then capable of being removed from between the pillow and pillowcase.

2. The insertion device of claim 1 wherein the compression handles, the compression handle stem, the plurality of deflectors, and the horizontal slot are all integrally formed from a single sheet of resilient plastic material.

3. The insertion device of claim 1 further including a handle fastening mechanism fixed adjacent the horizontal slot that is adapted to selectively fix the compression handle and compression handle stem with the resilient sheet adjacent the slot so as to maintain constriction of the pillow after the compression handles are pulled apart.

4. The insertion device of claim 3 wherein the handle fastening mechanism includes a two-part mechanical fastener, a first part of which is fixed adjacent the horizontal slot and a second part of which is fixed with a rear side of the compression handle.

5. The insertion device of claim 4 wherein the two-part mechanical fastener includes a hook-and-loop material type fastener.

6. The insertion device of claim 4 wherein the two-part mechanical fastener includes a plurality of magnets.

7. The insertion device of claim 1 wherein the bottom edge includes at least one removal handle projecting away therefrom, such that the sheet may be slid out from between the pillow and the pillowcase by pulling on the at least one removal handle.

8. The insertion device of claim 7 wherein the at least one removal handle is exactly two removal handles that are on opposing sides of the bottom edge of the enclosure when the sheet is formed into the enclosure.

9. The insertion device of claim 7 wherein the compression handles, the compression handle stem, the at least one removal handle, and the horizontal slot are all integrally formed from a single sheet of resilient plastic material.

10. The insertion device of claim 7 wherein the compression handles, the compression handle stem, the plurality of deflectors, the at least one removal handle, and the horizontal slot are all integrally formed from a single sheet of resilient plastic material.

11. A pillow insertion system comprising:

a pillow;

a pillow case; and a resilient sheet having a front side, a rear side, a top edge, a bottom edge, a left edge, and a right edge, the left edge including a compression handle stem projecting away therefrom and terminating at a compression handle, the right edge including a second compression handle projecting away therefrom, the sheet further including a horizontal slot traversing from the front side to the rear side and sharing a common longitudinal axis with the compression handle stem;

the top edge of the resilient sheet further including a plurality of deflectors projecting away therefrom and angled towards the rear side;

wherein the sheet is configured to be capable of having the left edge of the resilient sheet curved around itself such that the compression handle and compression handle stem traverse the horizontal slot from the rear side to the front side, the sheet forming an enclosure for the pillow that with pulling of the compression handle away from the second compression handle causes the sheet to constrict the pillow such that the pillow and the sheet are capable of being inserted into the pillowcase, the deflectors facilitating the insertion of the enclosure and the pillow into the pillowcase by deflecting the pillowcase material into a more open configuration, wherein the sheet is then capable of being removed from between the pillow and pillowcase.

12. The pillow insertion system of claim 11 further including a handle fastening mechanism fixed adjacent the horizontal slot that is adapted to selectively fix the compression handle and compression handle stem with the resilient sheet adjacent the slot so as to maintain constriction of the pillow after the compression handles are pulled apart.

13. The pillow insertion system of claim 11 wherein the bottom edge includes at least one removal handle projecting away therefrom, such that the sheet may be slid out from between the pillow and the pillowcase by pulling on the at least one removal handle.

14. The pillow insertion system of claim 11 wherein the compression handles, the compression handle stem, the plurality of deflectors, and the horizontal slot are all integrally formed from a single sheet of resilient plastic material.

15. The pillow insertion system of claim 13 wherein the compression handles, the compression handle stem, the at least one removal handle, and the horizontal slot are all integrally formed from a single sheet of resilient plastic material.

16. The pillow insertion system of claim 13 wherein the compression handles, the compression handle stem, the plurality of deflectors, the at least one removal handle, and the horizontal slot are all integrally formed from a single sheet of resilient plastic material.

* * * * *